US009228276B2

(12) United States Patent
Barton et al.

(10) Patent No.: US 9,228,276 B2
(45) Date of Patent: Jan. 5, 2016

(54) PROCESSES FOR PREPARING CARBON FIBERS USING GASEOUS SULFUR TRIOXIDE

(71) Applicant: Dow Global Technologies LLC, Midland, MI (US)

(72) Inventors: Bryan E. Barton, Midland, MI (US); Zenon Lysenko, Midland, MI (US); Mark T. Bernius, Bowling Green, OH (US); Eric J. Hukkanen, Midland, MI (US)

(73) Assignee: Dow Global Technologies LLC, Midland, MI (US)

( * ) Notice: Subject to any disclaimer, the term of this patent is extended or adjusted under 35 U.S.C. 154(b) by 0 days.

(21) Appl. No.: 14/413,457

(22) PCT Filed: Jul. 3, 2013

(86) PCT No.: PCT/US2013/049189
§ 371 (c)(1),
(2) Date: Jan. 8, 2015

(87) PCT Pub. No.: WO2014/011457
PCT Pub. Date: Jan. 16, 2014

(65) Prior Publication Data

US 2015/0167201 A1 Jun. 18, 2015

Related U.S. Application Data

(60) Provisional application No. 61/670,810, filed on Jul. 12, 2012.

(51) Int. Cl.

| | |
|---|---|
| ***D01F 9/21*** | (2006.01) |
| ***D01F 9/14*** | (2006.01) |
| ***D01F 9/20*** | (2006.01) |

(52) U.S. Cl.
CPC .. *D01F 9/21* (2013.01); *D01F 9/14* (2013.01); *D01F 9/20* (2013.01)

(58) Field of Classification Search
CPC ..... D06M 11/55; D06M 2101/20; D01F 9/21; D01F 9/14
USPC ..... 423/447.4
See application file for complete search history.

(56) References Cited

U.S. PATENT DOCUMENTS

| | | | |
|---|---|---|---|
| 4,070,446 | A | 1/1978 | Horikiri et al. |
| 4,113,666 | A | 9/1978 | Sano et al. |

(Continued)

FOREIGN PATENT DOCUMENTS

| | | | |
|---|---|---|---|
| CA | 1085089 | A1 | 9/1980 |
| WO | 9236301 | A2 | 3/1992 |

OTHER PUBLICATIONS

Pennings, et al. Amorphous carbon fibres from linear low density polyethylene. Journal of Materials Science. Oct. 1990, vol. 25, Issue 10, pp. 4216-4222.

(Continued)

*Primary Examiner* — Daniel C McCracken
(74) *Attorney, Agent, or Firm* — Christopher A. Johnson

(57) ABSTRACT

Disclosed herein are processes for preparing carbonized polymers, such as carbon fibers, comprising: sulfonating a polymer with a sulfonating agent that comprises $SO_3$ gas to form a sulfonated polymer; treating the sulfonated polymer with a heated solvent, wherein the temperature of said solvent is at least 95° C.; and carbonizing the resulting product by heating it to a temperature of 500-3000° C.

18 Claims, 2 Drawing Sheets

(56) References Cited

U.S. PATENT DOCUMENTS

| | | | | |
|---|---|---|---|---|
| 8,500,960 | B2 | 8/2013 | Ehrenberg et al. | |
| 2013/0214442 | A1* | 8/2013 | Naskar | D04H 1/4242 264/29.2 |

OTHER PUBLICATIONS

Pennings, et al. The effect of diameter on the mechanical properties of amorphous carbon fibres from linear low density polyethylene. Polymer Bulletin. Mar. 1991, vol. 25, Issue 3, pp. 405-412.

Ravi, V.A. Processing and Fabrication of Advanced Materials for High Temperature Applications II: Proceedinigs of a Symposium Sponsored by the Structural Material (No. 2). Jul. 1, 1993, pp. 475-485.

Zhang, et al. Carbon Fibers from Polyethylene-Based Precursors. Materials and Manufacturing Processes. 1994. vol. 9, Issue 2, pp. 221-235.

Leon y Leon. International SAMPE Technical Conference Series. 2002, vol. 34, pp. 506-519.

Karacan, et al. Use of sulfonation procedure for the development of thermally stabilized isotactic polypropylene fibers prior to carbonization. Journal of Applied Polymer Science. vol. 123, Issue 1, pp. 234-245, 2011.

* cited by examiner

| EXAMPLE | TEMPERATURE OF (°C) | TIME OF SULFONICATION (HOURS) | STRESS DURING SULFONICATION (MPa) | STRESS DURING CARBONIZATION (MPa) | YOUNG'S MODULUS (GPa) | TENSILE STRENGTH (GPa) | ELONGATION AT BREAK (%) |
|---|---|---|---|---|---|---|---|
| 1 | 70 | 3 | 7 | 4.5 | 47 | 0.40 | 0.86 |
| 2 | 70 → 90 | 3.5 | 14 | 4.5 | 49 | 0.54 | 1.10 |
| 3 | 70 | 3 | 14 → 7 | 4.5 | 36 | 0.40 | 1.10 |
| 4 | 70 | 4 | 11 | 4.5 | 52 | 0.53 | 1.03 |
| 5 | 70 | 4 | 11 | 9 | 58 | 0.60 | 1.02 |
| 6 | 70 | 3 | 14 | 4.5 | 46 | 0.71 | 1.55 |

Fig. 1

PROCESSES FOR PREPARING CARBON FIBERS USING GASEOUS SULFUR TRIOXIDE

CROSS REFERENCE TO RELATED APPLICATIONS

This application is a 35 USC §371 national phase filing of PCT/US2013/049189 filed Jul. 3, 2013, which claims the benefit of U.S. Application No. 61/670,810, filed Jul. 12, 2012.

STATEMENT OF GOVERNMENT INTEREST

This invention was made under a NFE-10-02991 between The Dow Chemical Company and UT-Batelle, LLC, operating and management Contractor for the Oak Ridge National Laboratory operated for the United States Department of Energy. The Government has certain rights in this invention.

BACKGROUND OF THE INVENTION

The world production of carbon fiber in 2010 was 40 kilo metric tons (KMT) and is expected to grow to 150 KMT in 2020. Industrial-grade carbon fiber is forecasted to contribute greatly to this growth, wherein low cost is critical to applications. The traditional method for producing carbon fibers relies on polyacrylonitrile (PAN), which is solution-spun into fiber form, oxidized and carbonized. Approximately 50% of the cost is associated with the polymer itself and solution-spinning.

In an effort to produce low cost industrial grade carbon fibers, various groups studied alternative precursor polymers and methods of making the carbon fibers. Many of these efforts were directed towards the sulfonation of polyethylene and the conversion of the sulfonated polyethylene to carbon fiber. But the methods and resulting carbon fibers are inadequate for at least two reasons. First, the resulting carbon fibers suffer from inter-fiber bonding. Second, the resulting carbon fibers have physical properties that are inadequate.

For example, U.S. Pat. No. 4,070,446 described a process of sulfonating high density polyethylene using chlorosulfonic acid (Examples 1 and 2), sulfuric acid (Examples 3 and 4), or fuming sulfuric acid (Example 5). Example 5 in this patent used 25% fuming sulfuric acid at 60° C. for two hours to sulfonate high-density polyethylene (HDPE), which was then carbonized. When the inventors used this method to sulfonate linear low density polyethylene (LLDPE), the resulting fibers suffered from inter-filament bonding, and poor physical properties. Consequently, this method was judged inadequate.

U.S. Pat. No. 4,113,666 made strongly acidic cation-exchanging fiber from fibrous polyethylene using sulfur trioxide gas as the sulfonating agent. Since the goal of this patent was to make acidic cation-exchanging fiber via gas phase sulfonation, the sulfonated fibers were not carbonized.

WO 92/03601 used a concentrated sulfuric acid method described in the U.S. Pat. No. 4,070,446 to convert ultra high molecular weight (UHMW) polyethylene fibers to carbon fibers. In Example 1 of this application, the polymer fibers (while under tension) were immersed in a 120° C., 98% sulfuric acid bath, the temperature of which was raised at a rate of 30° C. per hour to a maximum temperature of 180° C. The sulfonated fibers were then washed with water, air-dried, and then (incompletely) carbonized at a temperature up to 900° C. Examples 2 and 3 in this application are prophetic and do not contain any data. The sulfonation times and batch process methods disclosed in this reference are inadequate.

In Materials and Manufacturing Processes Vol. 9, No. 2, 221-235, 1994, and in Processing and Fabrication of Advanced Materials for High Temperature Applications—II; proceedings of a symposium, 475-485, 1993 Zhang and Bhat reported a process for the sulfonation of ultra-high molecular weight (UHMW) polyethylene fibers using sulfuric acid. Both papers report the same starting Spectra fibers and the same sulfonation process. The fibers were wrapped on a frame and immersed in 130-140° C. sulfuric acid and the temperature was slowly raised up to 200° C. Successful sulfonation times were between 1.5 and 2 hours. The fibers were removed at discrete intervals and washed with tap water, dried in an oven at 60° C. and carbonized in an inert atmosphere at 1150° C. Although good mechanical properties of the carbon fibers were reported by this method, an expensive gel-spun polymer fiber was utilized and the sulfonation time was inadequate.

In the early 1990s A. J. Pennings et al. (Polymer Bulletin, 1991, Vol. 25, pages 405-412; Journal of Materials Science, 1990, Vol 25, pages 4216-4222) converted a linear low-density polyethylene to carbon fiber by immersing fibers into room-temperature chlorosulfonic acid for 5-20 hours. This process would be prohibitively expensive from an industrial prospective due to the high cost of chlorosulfonic acid as well as the long reaction times.

In 2002, Leon y Leon (International SAMPE Technical Conference Series, 2002, Vol. 34, pages 506-519) described a process of sulfonating LLDPE fibers (d=0.94 g/mL) with warmed, concentrated $H_2SO_4$. A Two-stage sulfonated system was also described, wherein "relative to the first stage, the second sulfonation stage involves: (a) longer residence time at a similar temperature (or a larger single-stage reactor at a single temperature); or (b) a slightly higher acid concentration at a higher temperature." See page 514. Specific times and temperatures were not disclosed. In this reference tensile properties of the resulting carbon fibers were determined differently than is convention. Cross-sectional areas used for tensile testing were "calculated from density (by pycnometry) and weight-per-unit-length measurements" (pg 516, Table 3-pg 517). However, ASTM method D4018 and C1557 describe that diameters should be measured directly by microscopy or laser diffraction. After adjusting the reported tensile properties using the microscopy-measured diameters (Table 2, pg 517) new values were determined as follows:

| Trial # | Est. diameters | Measured diameters | Reported Young's Modulus (GPa) | Reported Tensile Strength (GPa) | Adjusted Young's Modulus (GPa) | Adjusted Tensile Strength (GPa) | Strain (%) |
|---|---|---|---|---|---|---|---|
| 22 | 9-10 | 14.3 | 105 | 0.903 | 51 | 0.44 | 0.86 |
| 26 | 9-10 | 13.2 | n.d. | 1.54 | n.d. | 0.89 | NA |
| 27 | 9-10 | 14.0 | 134 | 1.34 | 68 | 0.68 | 1.0 |

The methods disclosed in this reference produce carbon fibers having inadequate tensile strength and modulus.

In spite of these efforts, adequate methods of converting polyethylene based polymer fibers to carbon fiber are still needed. Thus disclosed herein are methods of making carbon fibers from polymer fibers, the methods comprising the sulfonation of the polymer fiber, subsequent hot solvent treatment of the sulfonated fibers, followed by carbonization of the fibers. These methods result in industrial grade carbon fibers having superior properties, when compared to those that were not treated with a hot solvent.

In one aspect, disclosed herein are processes for preparing carbonized polymers, the processes comprising:

a) sulfonating a polymer with a sulfonating agent that comprises $SO_3$ gas to form a sulfonated polymer;
b) treating the sulfonated polymer with a heated solvent, wherein the temperature of said solvent is at least 95° C., and
c) carbonizing the resulting product by heating it to a temperature of 500-3000° C.

The compounds and processes disclosed herein utilize polymeric starting materials. The polymeric starting materials may be in the form of fabrics, sheets, fibers, or combinations thereof. In a preferred embodiment, the polymeric starting material is in the form of a fiber and the resulting carbonized polymer is a carbon fiber.

In another aspect, disclosed herein are carbon fibers made according to the aforementioned processes.

In still another aspect, disclosed herein is an apparatus useful in the batch processes described herein.

DESCRIPTION OF THE FIGURES

FIG. 1 is a table reporting the data for various preparations of carbon fibers.

DETAILED DESCRIPTION

Figures 2A, 2B:
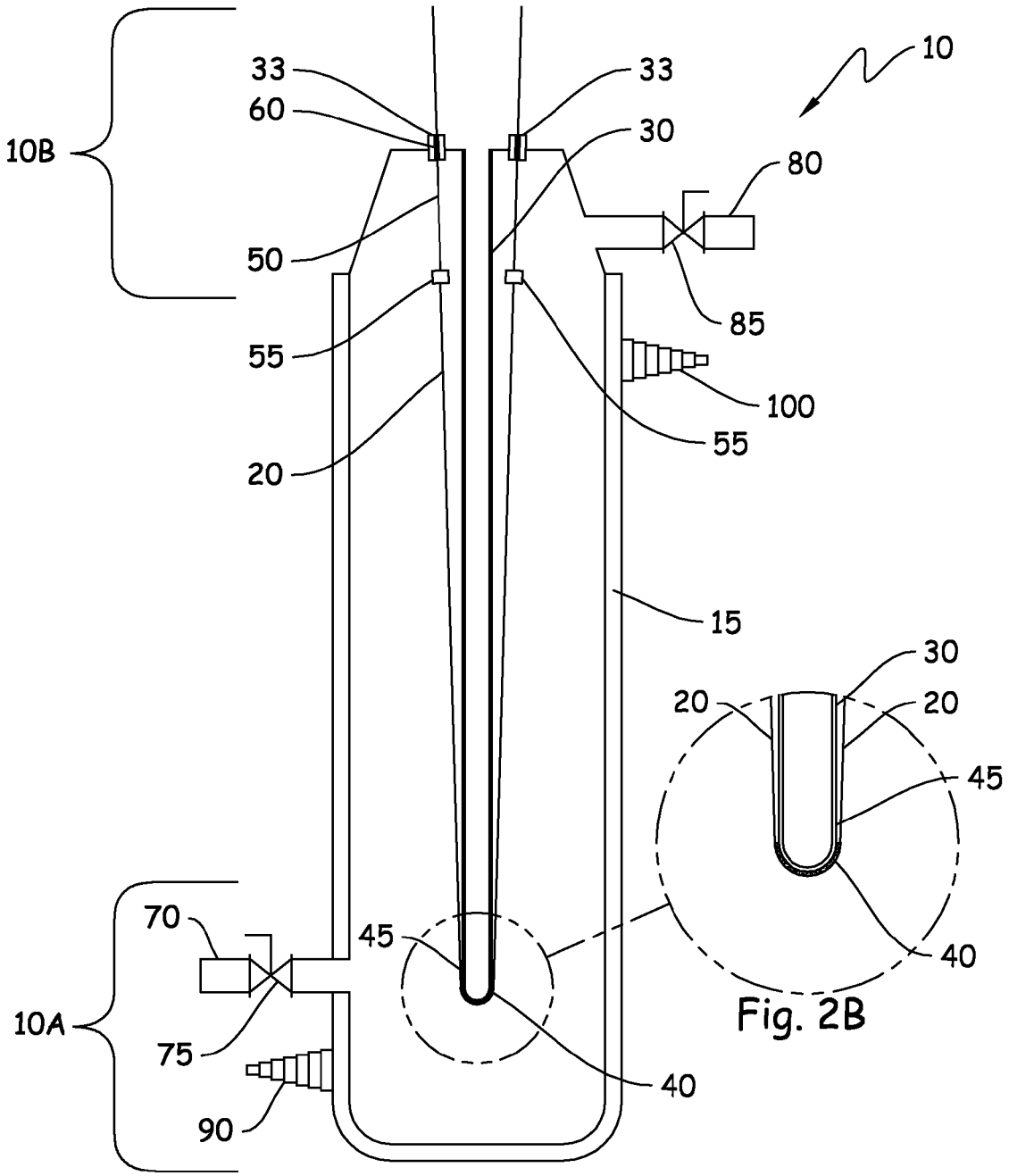
FIG. 2A is a schematic drawing of a device that can be used in the batch processes described herein.
FIG. 2B is an expanded view showing the polymer fiber going around the non-reactive material on the distal end of the glass rod.

As mentioned above, the sulfonating agent comprises $SO_3$ gas. If desired, pure (>99%) $SO_3$ gas may be used. In such cases, it should be noted that adding the $SO_3$ gas too quickly will result in the melting of the polymer, which is not desirable. Thus, the rate of addition, when using pure $SO_3$ gas is important.

Alternatively, the $SO_3$ gas may be used in combination with one or more carrier gases. Preferably, the carrier gas is an inert gas, such as air, nitrogen, carbon dioxide, helium, neon, argon, krypton or any other gas that does not impede the sulfonation reaction. Air and nitrogen are preferred for economic reasons.

The ratio of the $SO_3$ gas to the carrier gas is typically, in the range of 1:99 to 99:1 mol percent. More preferably, the range is 2:98 to 15:85 or 10:90 to 90:10 or 20:80 to 80:20. Still more preferably, the range is 1:99 to 30:70.

The carrier gas or gases should be dry, i.e., they have a water content of less than 5% by weight. More preferably, the water content is less than 4%, less than 3%, or less than 2%. More preferably, the water content is less than 1%. Dry gas is needed because moisture will react with the $SO_3$ gas to form $H_2SO_4$, which is not desirable. For the same reason, the polymer may be dried before it is sulfonated.

The rate of addition of the gases should be controlled in order to maximize the rate of sulfonation while minimizing any potential adverse effects, such as melting of the polymer.

The gas or gases may be added to the reaction vessel containing the polymer continuously, or it may be added in distinct "pulses." Additionally, the reaction chamber may be at ambient pressure or a pressure less than or more than ambient pressure.

The reaction temperature for the gas phase sulfonation reaction is typically from 20° C. to 132° C. (or any temperature that is below the melting point of the particular polymer at issue). More preferably, the temperature is 20-120° C. Cooler reaction temperatures may be used, but the properties are diminished and the economics are less favorable. More preferably, the reaction temperature is from 30-90° C. Yet still more preferably, the temperature is 30-75° C. Still more preferably, 50-70° C.

The gas phase sulfonation reaction typically takes 10 seconds to 8 hours to complete. Of course, it is known in the art that the sulfonation reaction time is affected by the fiber diameter (when a fiber is used), % crystallinity of the polymer, identity and concentration of the co-monomer(s)—if present, the density of the polymer, the concentration of double bonds in the polymer, porosity of the polymer, the sulfonation temperature, and the concentration of the gaseous $SO_3$. The optimization of sulfonation temperature, $SO_3$ gas concentration and addition rate, and reaction time are within the ability of one having skill in the art.

The sulfonation reaction is normally run at ambient/atmospheric pressure. But if desired, pressures greater or lesser than ambient pressure may be used.

One method of decreasing sulfonation reaction time is to swell the polymer with suitable solvent before or during the sulfonation reaction. In one embodiment, a polymer could be treated with a suitable swelling solvent prior to treatment with $SO_3$ gas. Alternatively, the polymer could be swelled with suitable solvent during the sulfonation step with an emulsion, solution, or otherwise combination of swelling agent and sulfonating agent. An additional benefit of performing a swelling step or steps before or during sulfonation is a more uniform sulfur distribution across the polymer and consequently enhanced processing conditions and properties.

After the polymer is sulfonated, it is treated with a heated solvent. Acceptable temperatures are at least 95° C. More preferably, at least 100° C. Still more preferably at least 105° C. or 110° C. Even more preferably, at least 115° C. Most preferred is at least 120° C. The maximum temperature is the boiling point of the solvent or 180° C. In one embodiment, the temperature of the solvent is 100-180° C. Alternatively, the temperature of the solvent is 120-180° C. While temperatures below 120° C. can be used, the reaction rate is slower and thus, less economical as the throughput of the reaction decreases.

In one embodiment, the preferred solvents are polar and/or protic. Examples of protic solvents include mineral acids, water, and steam. $H_2SO_4$ is a preferred protic solvent. In one embodiment, the heated solvent is $H_2SO_4$ at a temperature of 100-180° C. Still more preferably, the heated solvent is $H_2SO_4$ at a temperature of 120-160° C.

Alternatively, the heated solvent may be a polar solvent. Examples of suitable polar solvents include DMSO, DMF, NMP, halogenated solvents of suitable boiling point or combinations thereof. Preferably, the heated solvent is a polar solvent at a temperature of 120-160° C.

It should be understood that when polymer fibers are being used, the nature of the polymer fibers, their diameter, tow size, % crystallinity of the fibers, the identity and concentration of the co-monomer(s)—if present, and the density of the polymer fiber, will impact the reaction conditions that are used. Likewise, the temperature of the heated solvent used in the heated solvent treatment and the concentration of the $H_2SO_4$ (if $H_2SO_4$ is used) also depends on the nature of the polymer fibers, their diameter, tow size, and the % crystallinity of the fibers.

Once the sulfonation reaction is completed (which means 1%-100% of the polymer was sulfonated) (as determined using thermogravimetric analysis (TGA), the fibers may be degassed and optionally washed with one or more solvents. If the fiber is degassed, any method known in the art may be used. For example, the fibers may be subjected to a vacuum or sprayed with a pressurized gas.

If the polymer is washed, the washing encompasses rinsing, spraying or otherwise contacting the polymer with a solvent or combination of solvents, wherein the solvent or combination of solvents is at a temperature of from −100° C. up to 200° C. Preferred solvents include water, $C_1$-$C_4$ alcohols, acetone, dilute acid (such as sulfuric acid), halogenated solvents and combinations thereof. In one embodiment, the fibers are washed with water and then acetone. In another embodiment, the fibers are washed with a mixture of water and acetone. Once the fibers are washed, they may be blotted dry, air dried, heated using a heat source (such as a conventional oven, a microwave oven, or by blowing heated gas or gases onto the fibers), or combinations thereof.

The polymers used herein consist of homopolymers made from polyethylene, polypropylene, polystyrene, and polybutadiene, or comprise a copolymer of ethylene, propylene, styrene and/or butadiene. Preferred copolymers comprise ethylene/octene copolymers, ethylene/hexene copolymers, ethylene/butene copolymers, ethylene/propylene copolymers, ethylene/styrene copolymers, ethylene/butadiene copolymers, propylene/octene copolymers, propylene/hexene copolymers, propylene/butene copolymers, propylene/styrene copolymers, propylene butadiene copolymers, styrene/octene copolymers, styrene/hexene copolymers, styrene/butene copolymers, styrene/propylene copolymers, styrene/butadiene copolymers, butadiene/octene copolymers, butadiene/hexene copolymers, butadiene/butene copolymers, butadiene/propylene copolymers, butadiene/styrene copolymers, or a combination of two or more thereof. Homopolymers of ethylene and copolymers comprising ethylene are preferred. The polymers used herein can contain any arrangement of monomer units. Examples include linear or branched polymers, alternating copolymers, block copolymers (such as diblock, triblock, or multi-block), terpolymers, graft copolymers, brush copolymers, comb copolymers, star copolymers or any combination of two or more thereof.

The polymer fibers, when fibers are used, can be of any cross-sectional shape, such as circular, star-shaped, hollow fibers, triangular, ribbon, etc. Preferred polymer fibers are circular in shape. Additionally, the polymer fibers can be produced by any means known in the art, such as melt-spinning (single-component, bi-component, or multi-component), solution-spinning, electro-spinning, film-casting and slitting, spun-bond, flash-spinning, and gel-spinning. Melt spinning is the preferred method of fiber production.

It must be emphasized that the treatment with a heated solvent is vital to the inventions disclosed herein. As shown below, the heated solvent treatment significantly improves the physical properties of the resulting carbon fiber, when compared to carbon fibers that were not treated with a heated solvent. Without wishing to be bound to a particular theory, it is believed that the heated solvent treatment allows the fibers to undergo crosslinking, which improves their physical properties, while inhibiting the ability of the fibers to fuse or undergo inter-fiber bonding.

And as previously mentioned, in some embodiments, the sulfonation reaction is not run to completion. Rather, after the reaction is 1-99% complete (or more preferably 40-99% complete), the sulfonation reaction is stopped and then the sulfonation is completed in the hot solvent treatment step (when the hot solvent is a mineral acid, such as concentrated sulfuric acid.) If desired, the sulfonation, the treatment with a heated solvent and/or the carbonization may be performed when the polymer is under tension. The following discussion is based on the use of a polymer fiber (also called "tow"). It is known in the carbon fiber art that maintaining tension helps to control the shrinkage of the fiber. It has also been suggested that minimizing shrinkage during the sulfonation reaction increases the tensile properties of the resulting carbon fiber.

More specifically, sulfonic acid groups within sulfonated polyethylene fibers undergo a thermal reaction at ca. 145° C. (onset occurring around 120-130° C.) evolving $SO_2$ and $H_2O$ as products while generating new carbon-carbon bonds within the carbon chain. This was verified using Near-Edge X-Ray Absorption Fine Structure (NEXAFS) spectroscopy, which showed that heating sulfonated polyethylene fibers results in a decrease in C═C bonds and an increase in C—C single bonds. This result is consistent with the formation of new bonds between previously unbonded C atoms at the expense of C—C double bonds. The addition of solvent separates the individual filaments and prevents fiber fusion. See the scheme below, which illustrates the generic chemical transformation occurring during the entire process. It should be understood by one skilled in the art that the variety and complexity of other functional groups present at all steps and have been omitted here for the sake of clarity.

Scheme 1. The generic chemical process of a hydrocarbon reacting with $SO_3$ generating a polyacetylene-like polymer with sulfonic acid groups, a subsequent thermal step cross-linking the individual polymer chains, and dehydrogenation at elevated temperatures resulting in the desired carbon fiber.

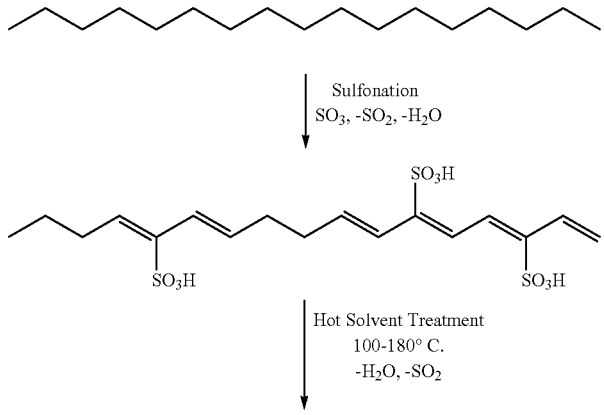

-continued

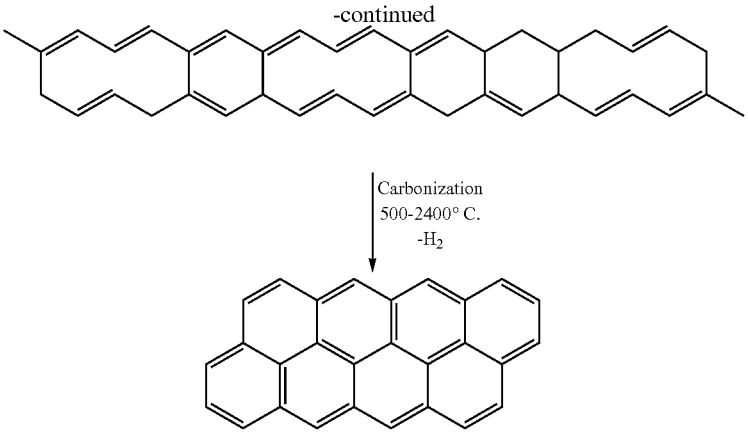

It must be emphasized that simply heating the sulfonated fibers in an oven results in a high degree of fiber-fusion, wherein different fibers fuse or otherwise aggregate; such fused fibers tend to be very brittle and to have poor mechanical properties. In contrast, the treatment of the sulfonated polymer fibers with a heated solvent results in fibers having significantly less fiber-fusion. Such fibers have improved tensile strength and higher elongation-to-break (strain) values. It is believed that the role of the solvent is to minimize the inter-fiber hydrogen bonding interactions between the surface sulfonic acid groups which thereby prevents inter-fiber cross-linking and fiber-fusion during the hot solvent treatment step. An alternative hypothesis employs the heated solvent to remove low molecular weight sulfonated polymer from the polymer fibers. Without removing this inter-fiber byproduct, heat treatment imparts similar cross-linking and ultimately creates the fusion of fibers.

It is possible that the sulfonation reaction will not go to completion, which (as is known in the art), results in hollow fibers. In such cases, using hot sulfuric acid in the hot solvent treatment will continue the sulfonation reaction and drive it towards completion, while the thermal reaction is also occurring. In one embodiment of this invention, one could produce hollow carbon fibers from this process by reducing the amount of time in the sulfonation chamber, the hot sulfuric acid bath, or both, while still retaining the advantage of producing non-fused fibers. If desired, adjusting the relative amounts of sulfonation performed in the sulfonation reaction and the hot solvent treatment can be used to alter the physical properties of the resulting carbon fibers.

If desired, the sulfonation, the treatment with a heated solvent and/or the carbonization may be performed when the polymer fiber (also called "tow") is under tension. It is known in the carbon fiber art that maintaining tension helps to control the shrinkage of the fiber. It has also been suggested that minimizing shrinkage during the sulfonation reaction increases the modulus of the resulting carbon fiber.

When using gaseous $SO_3$ to perform the sulfonation reaction, it was discovered that the polymer fiber could be kept under a tension of 0-22 MPa, (with tensions of up to 16.8 MPa being preferred) the treatment with a heated solvent could be conducted while the polymer fiber was under a tension of 0-25 MPa, and carbonization could be conducted while the polymer fiber was under a tension of 0-14 MPa. In one embodiment, the process was conducted wherein at least one of the three aforementioned steps was conducted under tension. In a more preferred embodiment, the sulfonation, the treatment with a heated solvent, and the carbonization are performed while the polymer fiber is under a tension greater than 1 MPa. As will be readily appreciated, it is possible to run the different steps at different tensions. Thus, in one embodiment, the tension during the carbonization step differs from that in the sulfonation step. It should also be understood that the tensions for each step also depend on the nature of the polymer, the size, and tenacity of the polymer fiber. Thus, the above tensions are guidelines that may change as the nature and size of the fibers change.

The carbonization step is performed by heating the sulfonated and heat treated fibers. Typically, the fiber is passed through a tube oven at temperatures of from 500-3000° C. More preferably, the carbonization temperature is at least 600° C. In one embodiment, the carbonization reaction is performed at temperature in the range of 700-1,500° C. The carbonization step may be performed in a tube oven in an atmosphere of inert gas or in a vacuum. One of skill in the art will appreciate that if desired, activated carbon fibers may be prepared using the methods disclosed herein.

In one preferred embodiment, the processes comprise:

a) sulfonating a polyethylene containing polymer with a sulfonating reagent that comprises $SO_3$ gas and a dry, inert carrier gas, wherein the sulfonation reaction is performed at a temperature of from 50-100° C., to form a sulfonated polymer;

b) treating the sulfonated polymer with a protic and/or polar solvent, wherein the temperature of the protic and/or polar solvent is 100-180° C., and c) carbonizing the resulting product by heating it to a temperature of 500-3000° C., wherein at least one of steps a), b) and c) is performed while the polymer is under tension.

In this preferred embodiment, the protic and/or solvent is DMSO, DMF, or a mineral acid; and/or the polyethylene containing polymer fibers are polyethylene homopolymers or polyethylene copolymers that comprise ethylene/octene copolymers, ethylene/hexene copolymers, ethylene/butene copolymers, ethylene/propylene copolymers, ethylene/styrene copolymers, ethylene/butadiene copolymers, or a combination of two or more thereof, and/or halogenated solvent is a chlorocarbon, and/or steps a), b) and c) are performed while the polymer (preferably a polymer fiber) is under a tension greater than 1 MPa.

Even more preferably, in this preferred embodiment, the protic solvent is a mineral acid that is concentrated sulfuric acid at a temperature of 115-160° C.

Also disclosed herein are carbon fibers made according to any of the aforementioned process.

With regards to the process of sulfonating the fibers, it is possible to use either a batch or continuous method. An example of an apparatus used to perform the batch method may be seen in FIG. 2A, wherein the apparatus is comprised of a jacketed reaction vessel 10 having a top section 10B and a bottom section 10A, that are connected via a middle section, (which may comprise a glass joint, not shown), septa 60 fitted into a wire pass-through 33, both of which are located in the top section 10B, an $SO_3$ gas inlet 70, and $SO_3$ gas outlet 80, and an optionally hollow glass rod 30, having a non-reactive material 40 (such as PTFE or other fluorinated hydrocarbon) attached to its distal end 45, and wherein rod 30 is optionally a thermowell. See FIG. 2B for an illustration of the polymer fiber 20 going around the non-reactive material 40 that is attached to the distal end 45 of the glass rod 30. The two components of the reaction vessel 10A and 10B allow for easy addition and removal of the polymer fiber 20.

Each end of the polymer fiber 20 is tied, knotted or otherwise attached 55 to a thin-gauge wire 50. If desired two different wires 50 may be used or a single wire 50 may be used. When in position for a sulfonation reaction, a wire 50 enters the reaction vessel 10 via septa 60, which is located in the wire pass through 33, which is located in top section 10B. The polymer fiber 20, which is attached to wire 50 is guided down one side of the glass rod 30, around the non-reactive end 40, and back up the other side of the glass rod 30. This end of the polymer fiber 20 is attached to a wire 50, which exits the reaction vessel via a different septa 60, which is located in a wire pass through 33, which is also located in the top section 10B. If desired, tension is then placed on the fiber by addition of weights (not shown) to the wires 50 exterior to the apparatus 10.

In FIG. 2, the pass-through 33 and septa 60 prevent gases or vapors from entering into or escaping from reaction vessel 10, while allowing for tension to be applied to the polymer fiber 20. Additionally, the septa 60 should be non-reactive towards all reagents that are used and generated in the sulfonation reaction. Once the polymer fiber 20 is in place and under the desired amount of tension, if desired, purging with desired atmosphere can be achieved by directing gas flow through inlet 70 and outlet 80, the inlet 70 and outlet 80 may be fitted with a valve 75 and 85 to aide in controlling gas flow. Addition of a sulfur trioxide gas mixture can be achieved by directing flow through the same inlet 70 and outlet 80 with optional valves 75 and 85. Alternatively, the inlet and outlet direction can be reversed, such that the inlet is 80 and outlet is 70.

Upon addition of sulfur trioxide to reaction vessel 10, the gas (not shown) fills the interior space of the reaction vessel 10, where it contacts and sulfonates the polymer fiber 20. Unreacted gas and any gaseous or vapor by-products then exit the reaction vessel 10, via the $SO_3$ gas outlet 80, which may be fitted with a valve 85, that allows the operator to turn off the gas flow.

The reaction vessel 10 may be equipped with a jacketing device 15 for heating and/or cooling the vessel 10. In the design shown in FIG. 2, heating and cooling is achieved via a jacket 15 which allows for the recirculation of a fluid (not shown). The heating or cooling liquid enters the jacket 15 at one point 90 and leaves it at a different point 100. Points 90 and 100 should be far apart from each other, in order to maximize the efficiency of the heating or cooling of vessel 10 and the contents therein. Optionally, a glass rod 30 may be hollow allowing for a thermocouple to be used to directly monitor the temperature of the internal gas. All materials used to make the reaction vessel 10 should be made of glass or any material that does not react with the $SO_3$ gas, sulfuric acid or any by-products formed during the reaction.

When the reaction is complete, the gas is removed from the reaction vessel 10 by blowing inert gas and/or air through gas inlet 70 or gas outlet 80, until the $SO_3$ is removed. Alternatively, a vacuum source (not shown) may be attached to gas inlet 70 or gas outlet 80 and the reaction vessel may be evacuated. Then, an inert gas and/or air may be introduced into the reaction vessel 10, via gas inlet 70 or outlet 80.

In the following examples, tensile properties (young's modulus, tensile strength, % strain (% elongation at break)) for single filaments (fibers) were determined using a dual column Instron model 5965 following procedures described in ASTM method C1557. Fiber diameters were determined with both optical microscopy and laser diffraction before fracture.

EXAMPLE 1

Control

A copolymer of ethylene and 0.33 mol % 1-octene (1.3 weight %) having $M_w$=58,800 g/mol and $M_w/M_n$=2.5 was spun into a continuous tow of filaments. The filaments had diameter of 15-16 microns, a tenacity of 2 g/denier, and crystallinity of ~57%. A 1 meter sample of 3000 filaments was tied through the glass apparatus and placed under 400 g tension (7 MPa). The glass apparatus (FIG. 2) was heated to 70° C. and ~2.5-7% $SO_3$ in argon was fed into the reactor at a rate of 400-500 mL/min. After 3 hr the flow was turned off, the fiber was removed, washed with water, acetone, and blotted dry. The sulfonated fiber tow was then placed into a tube furnace under 250 g (4.5 MPa) tension and heated to 1150° C. over 5 hr under nitrogen. Individual filaments from this tow were tensile tested. The average of 15 filaments provided a Young's modulus of 47 GPa, a tensile strength of 0.40 GPa, an elongation-to-break of 0.86%, and a diameter of 12.6 microns.

EXAMPLE 2

Control

The same fiber and reactor was used as in Example 1. The 3000 filament fiber tow was placed under 800 g tension (15 MPa). The glass apparatus was heated to 70° C. and ~2.5-7% $SO_3$ in argon was fed into the reactor at a rate of 400-500 mL/min. After 3 hr the temperature was increased to 85° C. and held for 7 min, and then increased to 90° C. and held for 5 min. The flow was then turned off, the fiber was removed, washed with water, acetone, and blotted dry. The sulfonated fiber tow was then placed into a tube furnace under 250 g (4.5 MPa) tension and heated to 1150° C. over 5 hr under nitrogen. Individual filaments from this tow were tensile tested. The average of 15 filaments provided a Young's modulus of 49 GPa, a tensile strength of 0.54 GPa, an elongation-to-break of 1.10%, and a diameter of 15.1 microns.

EXAMPLE 3

Control

The same fiber and reactor was used as in Example 1. The 3000 filament fiber tow was placed under 800 g tension (15 MPa). The glass apparatus was heated to 70° C. and ~2.5-7% $SO_3$ in argon was fed into the reactor at a rate of 400-500 mL/min. After 1 hr the tension was changed to 400 g (7 MPa). After 3 hr the flow was turned off, the fiber was removed, washed with water, acetone, and blotted dry. The sulfonated fiber tow was then placed into a tube furnace under 250 g (4.5 MPa) tension and heated to 1150° C. over 5 hr under nitrogen. Individual filaments from this tow were tensile tested. The average of 15 filaments provided a Young's modulus of 36 GPa, a tensile strength of 0.40 GPa, an elongation-to-break of 1.1%, and a diameter of 15.1 microns.

EXAMPLE 4

Control

The same fiber and reactor was used as in Example 1. The 3000 filament fiber tow was placed under 600 g tension (11 MPa). The glass apparatus was heated to 70° C. and ~2.5-7% $SO_3$ in argon was fed into the reactor at a rate of 400-500 mL/min. After 4 hr the flow was turned off, the fiber was removed, washed with water, acetone, and blotted dry. The sulfonated fiber tow was then placed into a tube furnace under 250 g (4.5 MPa) tension and heated to 1150° C. over 5 hr under nitrogen. Individual filaments from this tow were tensile tested. The average of 15 filaments provided a Young's modulus of 52 GPa, a tensile strength of 0.53 GPa, an elongation-to-break of 1.0%, and a diameter of 14.3 microns.

EXAMPLE 5

Control

Same conditions as reported for Example 4, except the sulfonated fiber tow was placed into a tube furnace under 500 g (9 MPa) tension and heated to 1150° C. over 5 hr under nitrogen. Individual filaments from this tow were tensile tested. The average of 15 filaments provided a Young's modulus of 58 GPa, a tensile strength of 0.60 GPa, an elongation-to-break of 1.0%, and a diameter of 13.6 microns.

EXAMPLE 6

Experiment

The same fiber and reactor was used as in Example 1. The 3000 filament fiber tow was placed under 800 g tension (15 MPa). The glass apparatus was heated to 70° C. and ~2.5-7% $SO_3$ in argon was fed into the reactor at a rate of 400-500 mL/min. After 3 hr the flow was turned off, the fiber was removed and placed in a similar reactor and tensioned with 600 g (11 MPa). The reactor was filled with 96% $H_2SO_4$ and heated to 98° C. and held for 1 hour, then heated further to 115° C. and held for an additional hour. The fiber was then removed, washed with water, acetone, and blotted dry. The sulfonated fiber tow was then placed into a tube furnace under 250 g (4.5 MPa) tension and heated to 1150° C. over 5 hr under nitrogen. Individual filaments from this tow were tensile tested. The average of 15 filaments provided a Young's modulus of 46 GPa, a tensile strength of 0.71 GPa, an elongation-to-break of 1.55%, and a diameter of ~15 microns.

What is claimed is:

1. Processes for preparing carbonized polymer, the processes comprising a) sulfonating a polymer with a sulfonating agent that comprises $SO_3$ gas to form a sulfonated polymer;

b) treating the sulfonated polymer with a heated solvent, wherein the heated solvent is sulfuric acid at a temperature of at least 95° C.; and c) carbonizing the resulting product by heating it to a temperature of 500-3000° C.

2. Processes according to claim 1, wherein the sulfonating agent comprises $SO_3$ gas in combination with a carrier gas.

3. Processes according to claim 2, wherein the carrier gas is dry.

4. Processes according to claim 2, wherein the carrier gas is an inert gas.

5. Processes according to claim 1, wherein the polymer is a homopolymer that consists of polymers that are selected from polyethylene, polypropylene, polystyrene, and polybutadiene or wherein the polymer fiber is a copolymer of ethylene/octene copolymers, ethylene/hexene copolymers, ethylene/butene copolymers, ethylene/propylene copolymers, ethylene/styrene copolymers, ethylene/butadiene copolymers, propylene/octene copolymers, propylene/hexene copolymers, propylene/butene copolymers, propylene/styrene copolymers, propylene butadiene copolymers, styrene/octene copolymers, styrene/hexene copolymers, styrene/butene copolymers, styrene/propylene copolymers, styrene/butadiene copolymers, butadiene/octene copolymers, butadiene/hexene copolymers, butadiene/butene copolymers, butadiene/propylene copolymers, butadiene/styrene copolymers, or a combination of two or more thereof.

6. Processes according to claim 1, wherein the heated solvent is at a temperature of at least 100° C.

7. Processes according to claim 1, wherein the heated solvent is at 100-180° C.

8. Processes according to claim 1, wherein the sulfonation reaction is performed at a temperature of 20-120° C.

9. Processes according to claim 1, wherein the sulfonation is conducted while the polymer is a polymer fiber, and the polymer fiber is under a tension of 0-22 MPa, the treatment with a heated solvent is conducted while the polymer fiber under a tension of 0-25 MPa, or carbonization is conducted while the polymer fiber is under a tension of 0-14 MPa.

10. Processes according to claim 1, wherein the sulfonation, the treatment with a heated solvent, and the carbonization are performed while the polymer is under a tension greater than 1 MPa.

11. Processes according to claim 9, wherein the tension during the carbonization step differs from that in the sulfonation step.

12. Processes according to claim 1, wherein the carbonization step is performed at temperatures of from 700-1,500° C.

13. Processes according to claim 1, comprising:

a) sulfonating a polyethylene containing polymer with a sulfonating reagent that comprises $SO_3$ gas and a dry, inert carrier gas, wherein the sulfonation reaction is performed at a temperature of from 50-100° C. to form a sulfonated polymer;

b) treating the sulfonated polymer with a heated solvent, wherein the temperature of the solvent is 100-180° C.; and c) carbonizing the resulting product by heating it to a temperature of 500-3000° C.;

wherein at least one of steps a), b) and c) is performed while the polymer is under tension.

14. Processes according to claim 13, wherein the heated solvent is DMSO, DMF, or a mineral acid.

15. Processes according to claim 13, wherein the polyethylene containing polymers are polyethylene homopolymers or polyethylene copolymers that comprise an ethylene/octene copolymer, an ethylene/hexene copolymer, an ethylene/butene copolymer, an ethylene/propylene copolymer, a mixture of one or more homopolymers and one or more polyethylene copolymers, or a combination of two or more polyethylene copolymers.

16. Processes according to claim 13, wherein the heated solvent is sulfuric acid at a temperature of 115-160° C.

17. Processes according to claim 13, wherein steps a), b) and c) are performed while the polymer is under a tension greater than 1 MPa.

18. Processes according to claim 13, wherein the heated solvent is concentrated sulfuric acid at a temperature of 115-160° C.

* * * * *